US005893213A

United States Patent [19]

Motta

[11] Patent Number: 5,893,213

[45] Date of Patent: Apr. 13, 1999

[54] PROTECTIVE COVER FOR SHAVING CARTRIDGE

[75] Inventor: Vincent C. Motta, West Norfolk, Conn.

[73] Assignee: Warner-Lambert Company, Morris Plains, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/854,502

[22] Filed: May 12, 1997

[51] Int. Cl.[6] ..... B26B 21/40

[52] U.S. Cl. ..... 30/540; 30/539

[58] Field of Search ..... 30/41, 50, 84, 30/539, 540

[56] References Cited

U.S. PATENT DOCUMENTS

| | | | |
|---|---|---|---|
| 3,172,202 | 3/1965 | Sooter | 30/539 |
| 3,177,582 | 4/1965 | Curtis | 30/540 |
| 3,388,468 | 6/1968 | Hamill | 30/540 |
| 3,530,574 | 9/1970 | Patterson | 30/540 |
| 4,476,630 | 10/1984 | Byrne . | |
| 4,679,324 | 7/1987 | Kirk . | |
| 4,709,476 | 12/1987 | Shurtleff et al. | 30/41 |
| 4,996,772 | 3/1991 | Iten | 30/41 |

FOREIGN PATENT DOCUMENTS

| | | |
|---|---|---|
| 761393 | 12/1997 | European Pat. Off. . |
| 983028283 | 4/1998 | European Pat. Off. . |
| 2147535 | 5/1985 | United Kingdom . |

*Primary Examiner*—Hwei-Siu Payer
*Attorney, Agent, or Firm*—Charles W. Almer

[57] ABSTRACT

A removable protective cover for use with razors and razor cartridges. The cover encloses and protects the razor head, which contains the exposed portion of the sharpened blade or blades. Lateral tabs having hooks for engagement with the razor cartridge on one end and a button area on the other end are affixed to both ends of the cover via hinges. When the button area is depressed by opposing forces, in an X-plane, the hook end disengages from the razor cartridge and the cartridge may be removed from the protective cover with minimal or no force in the Y-direction which is perpendicular to the X-plane.

7 Claims, 4 Drawing Sheets

PROTECTIVE COVER FOR SHAVING CARTRIDGE

BACKGROUND OF THE INVENTION

1. Field of the Invention

This invention relates to a cover for use with shaving cartridges to protect the cartridge during periods of non-use.

2. Description of Related Art

Various types of protective covers have been utilized with commercially available razors and razor cartridges. The purpose of such covers is basically two-fold. First, the cover protects the razor and its blade edge(s) during the different stages of its life, such as shipping and retailing, from forces which would damage the edge(s). Second, the cover protects the user from unintentionally encountering the razor's sharp blade or blades when the razor is not in use. The covers which are currently available require a removal force in the direction of separation, i.e., the cover is either pulled or pushed directly off of the razor in the direction of the applied force. The result is that covers which are subjected to a single direction force frequently become dislodged from the razor during interim steps, such as shipping, causing those uncovered razors to be discarded.

Consequently, it is an objective of the present invention to provide a protective cover for a razor which requires a force for removal in a different direction than the direction of separation of the cartridge from the cover. Such a cover would require minimal or no force in the direction of separation between the razor and the cover.

SUMMARY OF INVENTION

The present invention is directed to a protective cover for use with razors and razor cartridges. The protective cover encloses and protects the razor head which contains the exposed portion of the sharpened blade or blades. Lateral tabs having hooks for engagement with the razor cartridge on one end and a button area on the other end are affixed to both ends of the cover via hinges. When the button area is depressed by opposing forces in an X-plane, the lateral tab pivots and the hook end disengages from the razor cartridge allowing the cartridge to be removed from the protective cover with minimal or no force in a Y-direction which is perpendicular to the X-plane.

DESCRIPTION OF THE PREFERRED EMBODIMENTS

Reference will now be made in detail to the presently preferred embodiments of the invention.

Figure 1:
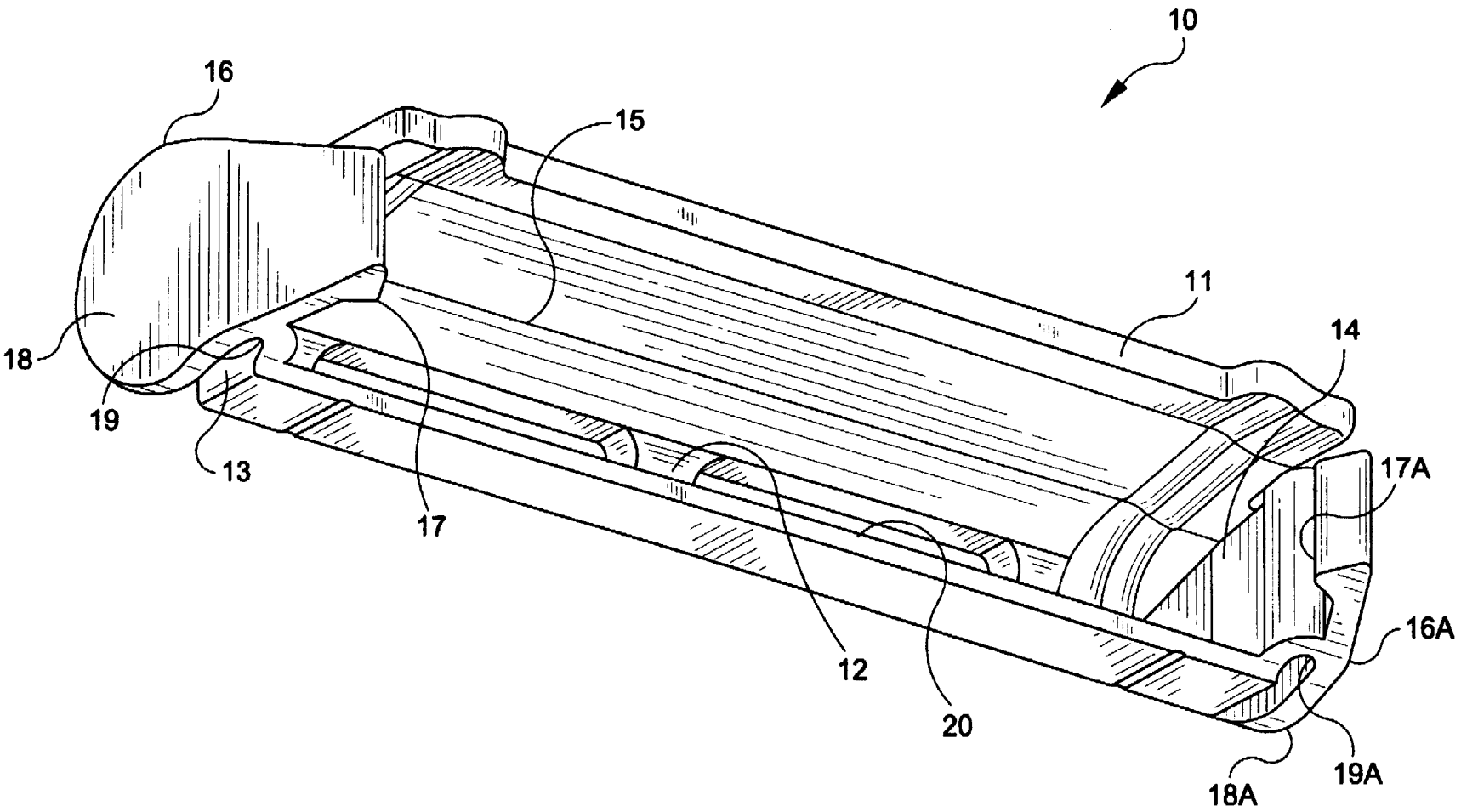
FIG. 1 is a perspective view of the protective cover.
Figure 2:
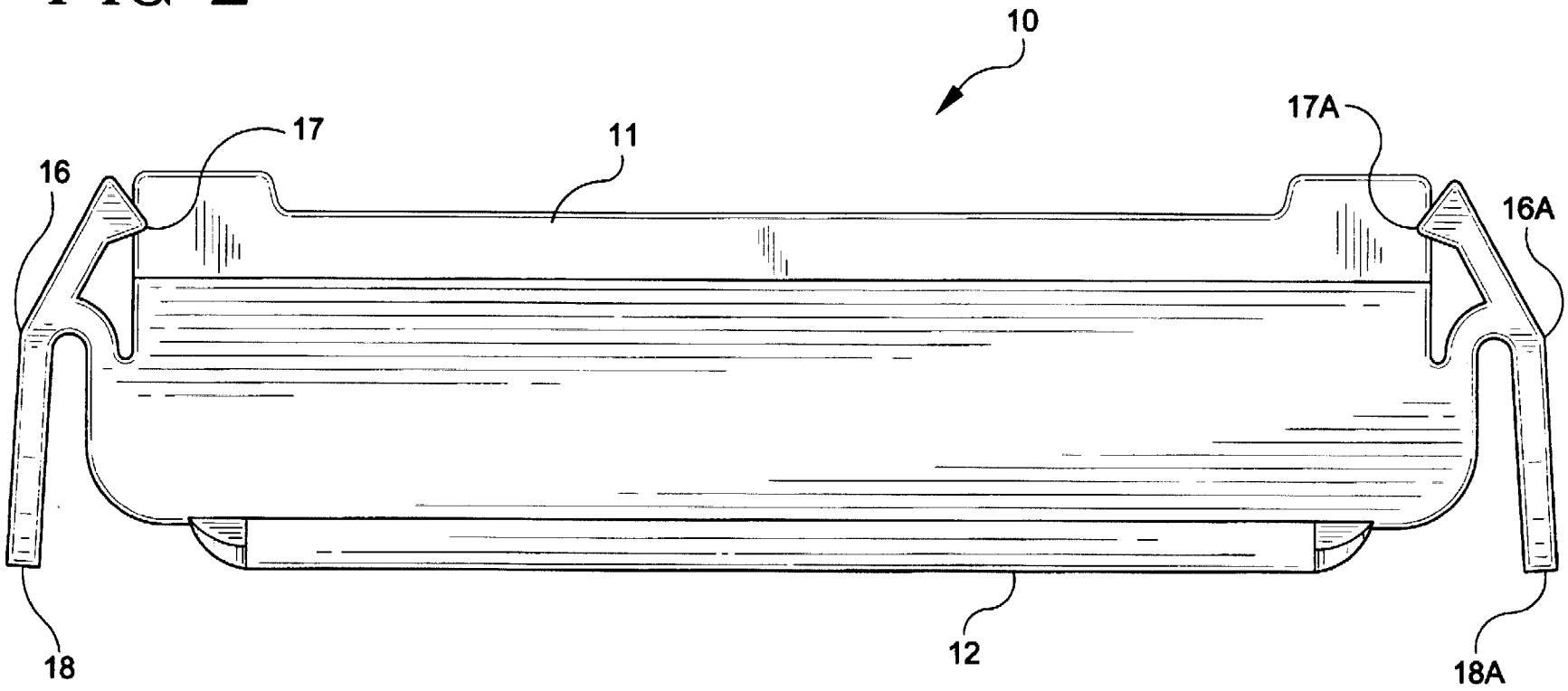
FIG. 2 is a front view of the protective cover.

As illustrated in FIGS. 1 and 2, the protective cover of the present invention comprises front wall 10, back wall 11, bottom wall 12 and side walls 13, 14 which combine to form open area 15. Bottom wall 12 is preferably curved and sufficiently wide so as to space back wall 11 and front wall 10 far enough apart from each other so that open area 15 is of sufficient size to accommodate the desired style of razor head or cartridge. As many commercially available razors contain shaving aids which swell to a larger size once they come into contact with water, in the preferred embodiment additional space is contained within the open area such that the razor cartridge will still fit within the open area when the shaving aid is swollen. In the preferred embodiment, one or more openings 20 are located on the bottom wall in order to allow for drainage of any moisture which may remain on the razor head when it is placed in the cover after use.

Figure 3:
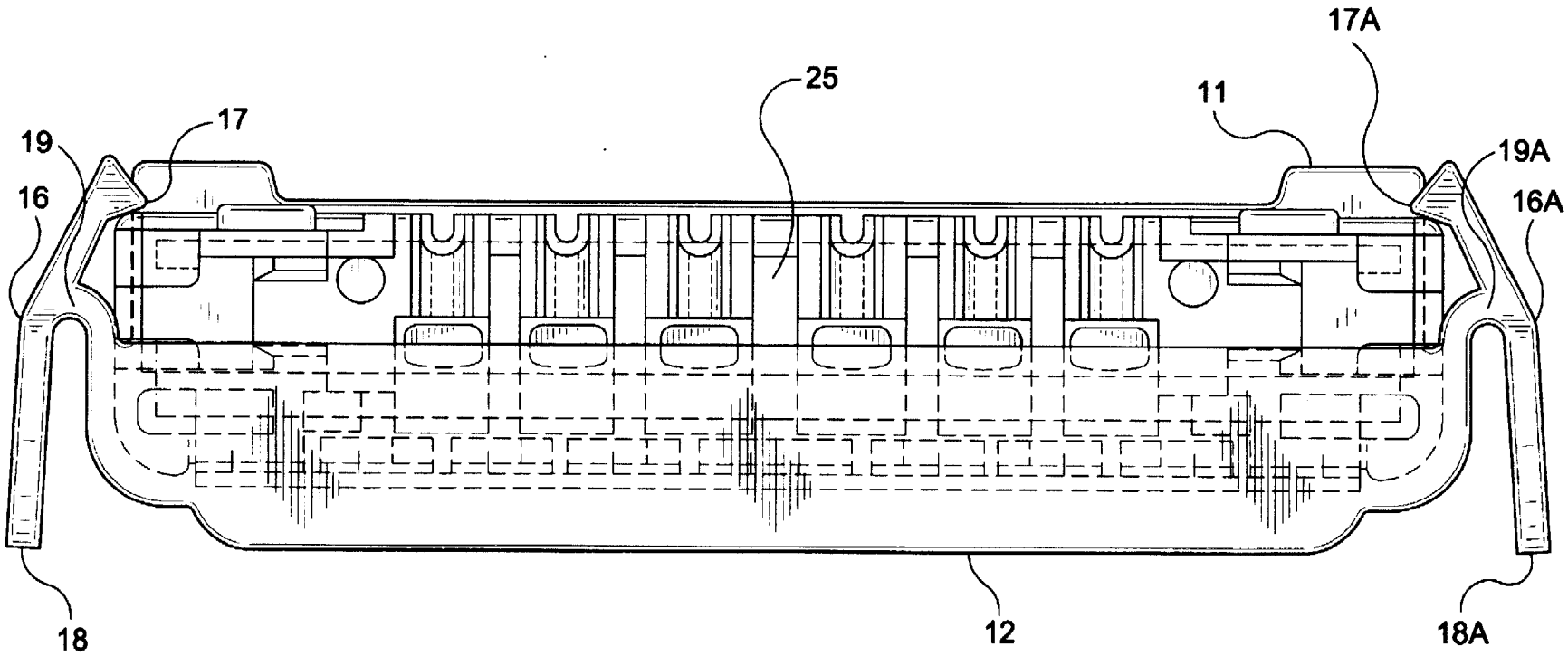
FIG. 3 is a cutaway front view of the protective cover containing a razor cartridge engaged with the lateral tabs.

Means for engaging and disengaging the razor cartridge, preferably lateral tabs 16, 16A, are located adjacent to the side walls. The lateral tabs 16, 16A are affixed to the side walls via hinge means 19, 19A. As illustrated, the hinge means are preferably living hinges and may be integrally molded with one or both of the side walls and/or the lateral tabs. The lateral tabs each comprise an upper portion which contains attachment means 17, 17A and a lower, button-like portion 18, 18A. Although shown in a semi-circle shape, the lower portions 18, 18A of the lateral tabs 16, 16A may be of any desired shape and texture, including a texture which will provide a gripping, non-slip surface. Attachment means 17, 17A may be of any form sufficient to retain a razor cartridge within the protective cover. Preferably, teeth such as those illustrated are employed. As illustrated in FIG. 3, a razor cartridge 25 fits within the open area. The razor cartridge may be handleless, such as a replacement cartridge for a permanent razor system, or affixed to a razor handle, such as is the case with a disposable razor. In the at rest position the engagement means are biased inward so that the attachment means 18, 18A engage the razor cartridge 25 and the lower portions of the lateral tabs 16, 16A are biased outward so that they are spaced away from the side walls of the protective cover.

Figure 4:
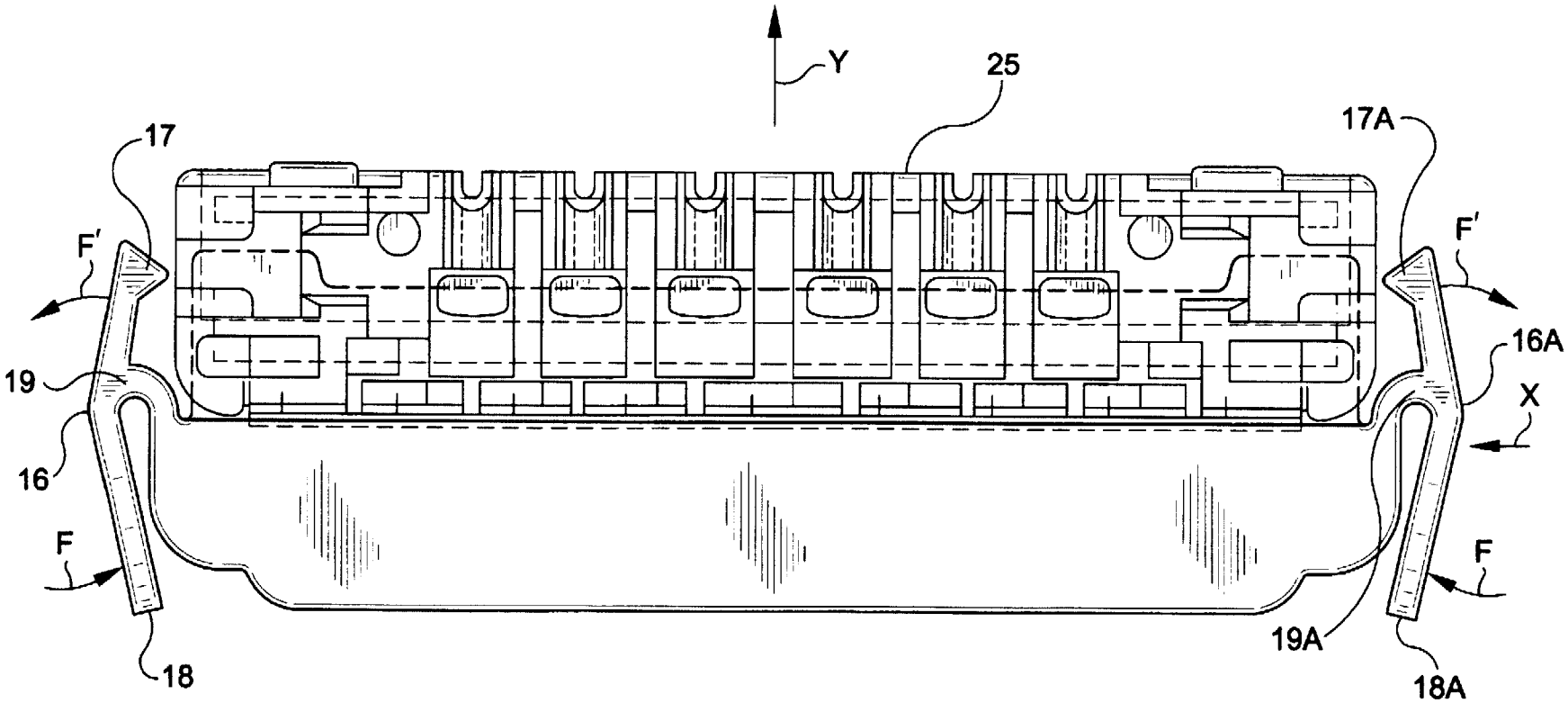
FIG. 4 is a cutaway front view of the protective cover containing a razor cartridge disengaged with the lateral tabs.

FIG. 4 illustrates the removal of a razor cartridge 25 from the protective cover. To remove the cartridge 25 opposing inward forces F in the plane of X are applied to the lower, button-like portions 18, 18A of the lateral tabs 16, 16A which forces cause the lower portions to move inward toward the side walls. Forces F also cause the lateral tabs 16, 16A to pivot on hinges 19, 19A such that teeth 17, 17A move outward in the direction F and away from the cartridge 25, causing clearance between the cartridge 25 and the lateral tabs 16, 16A and thus disengagement of the engagement means from the cartridge. At this point no connection is provided between the cartridge and the protective cover. The cartridge 25 is removable in the direction Y which is perpendicular to the plane of the direction of the forces F with minimal or no force required in the direction of separation of the cartridge and cover. In order to insert the cartridge into the cover the cartridge is pushed downward in the opposite direction of Y and the natural flexibility of the hinge allows for the cartridge to be snapped into the cover. If so desired, forces F may also be applied during insertion so that the cartridge may be inserted without any snapping. The insertion and removal may be repeated any number of times such that the user can replace the cover on the cartridge between uses. The amount of force F required to engage or disengage the cartridge may be controlled via the choice of material from which the lateral tabs are constructed, different material thickness of the lateral tabs and the length of the attachment means. For example, constructing the lateral tabs from a thick, firm material will result in a cover which requires a greater force to remove than a cover which is constructed from a thin, weak material. Also, a cover having long teeth will require a greater force to engage or disengage as the teeth must travel a greater distance to provide the desired result than shorter teeth. One particular advantage of the need for opposing forces to remove the cover is that the cover will not accidentally fall off of the razor if submitted to a one-directional force.

While there have been described what are presently believed to be the preferred embodiments of the present invention, those skilled in the art will realize that various changes and modifications may be made to the invention without departing from the spirit of the invention, and it is intended to claim all such changes and modifications as fall within the scope of the invention.

I claim:

1. A protective cover for a razor head, comprising a front wall, a back wall, two side walls, a bottom wall and two lateral tabs each with two free ends and a portion between the free ends, one of the lateral tabs having the portion affixed to one of the side walls at a first hinge means, and the other of the lateral tabs having the portion affixed to the other of the side walls at a second hinge means, wherein the lateral tabs are pivotable and movable upon the application of an opposing force in order to engage or disengage a razor cartridge of the razor head from the protective cover and wherein the protective cover is removable from the razor head in a direction which is perpendicular to the plane of the direction of the force required to disengage the cover from the razor head.

2. The protective cover of claim 1, wherein the free ends comprises upper and lower ends.

3. The protective cover of claim 2, wherein each of the upper ends of the lateral tabs comprise a hook for engagement with the razor cartridge.

4. The protective cover of claim 1, wherein the bottom wall contains one or more drainage openings.

5. The protective cover of claim 4, wherein the cover comprises an open area to accommodate the razor cartridge having a shaving aid which has been swollen due to contact with moisture.

6. The protective cover of claim 1, in combination with a razor cartridge.

7. A method of removing a protective cover from a razor cartridge comprising the steps of:

a) providing a protective cover for a razor head, said protective cover comprising a front wall, a back wall, two side walls, a bottom wall and two lateral tabs each with two free ends and a portion between the free ends, one of the lateral tabs having the portion affixed to one of the side walls at a first hinge means, the other of the lateral tabs having the portion affixed to the other of the side walls at a second hinge means, wherein the lateral tabs are pivotable and movable upon the application of an opposing force in order to engage or disengage a razor cartridge from the protective cover;

b) providing an opposing force on the lateral tabs to pivot the lateral tabs out of engagement with the razor cartridge; and c) removing the cartridge in a direction perpendicular to the direction of the force on the lateral tabs.

* * * * *